US009874226B2

(12) United States Patent
Fukuyama

(10) Patent No.: US 9,874,226 B2
(45) Date of Patent: Jan. 23, 2018

(54) CENTRIFUGAL COMPRESSOR

(71) Applicant: KABUSHIKI KAISHA TOYOTA JIDOSHOKKI, Aichi-ken (JP)

(72) Inventor: Ryosuke Fukuyama, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 331 days.

(21) Appl. No.: 14/666,863

(22) Filed: Mar. 24, 2015

(65) Prior Publication Data

US 2015/0275917 A1 Oct. 1, 2015

(30) Foreign Application Priority Data

Mar. 26, 2014 (JP) ..... 2014-063570

(51) Int. Cl.
*F04D 29/46* (2006.01)
*F04D 27/02* (2006.01)
*F04D 17/10* (2006.01)

(52) U.S. Cl.
CPC ..... *F04D 29/464* (2013.01); *F04D 17/10* (2013.01); *F04D 27/0253* (2013.01); *F05D 2220/40* (2013.01)

(58) Field of Classification Search
CPC .... F04D 29/464; F04D 17/10; F04D 27/0253; F04D 29/468; F04D 29/56; F04D 27/0246; F04D 15/0022; F04D 27/002; F04D 27/003; F04D 27/009; F04D 27/0207; F04D 27/0215; F04D 27/023; F04D 27/0238; F05D 2220/40
(Continued)

(56) References Cited

U.S. PATENT DOCUMENTS 2,933,237 A * 4/1960 Darrow ..... F04D 29/464 415/146
2,996,996 A * 8/1961 Jassniker ..... F01D 17/143 415/126
(Continued)

FOREIGN PATENT DOCUMENTS

CH 133892 A * 6/1929 ..... F04D 15/0038
DE 881306 C * 6/1953 ..... F04D 15/0038
(Continued)

*Primary Examiner* — Kenneth Bomberg
*Assistant Examiner* — Brian Delrue
(74) *Attorney, Agent, or Firm* — Baker & Hostetler LLP

(57) ABSTRACT

A centrifugal compressor includes a housing, an impeller, an annular diffuser passage, and an annular movable member. The diffuser passage is defined in the housing by a shroud-side wall surface and a hub-side wall surface, which face each other. The movable member is configured to be projected from one of the shroud-side wall surface and the hub-side wall surface into the diffuser passage and to be retracted from the diffuser passage. The movable member has a through hole with a passage cross-sectional area smaller than that of the diffuser passage. The other of the shroud-side wall surface and the hub-side wall surface has an abutting portion against which the movable member abuts. When the movable member abuts against the abutting portion, the upstream side and the downstream side of the movable member in the diffuser passage communicate with each other via the through hole.

9 Claims, 6 Drawing Sheets

(58) Field of Classification Search
USPC ..... 415/148, 53.3, 150, 57.1, 57.3–57.4, 415/58.2–58.4
See application file for complete search history.

(56) References Cited

U.S. PATENT DOCUMENTS 3,032,259 A * 5/1962 Jassniker ..... F01D 17/143 415/148
3,160,392 A * 12/1964 Hunter ..... F01D 17/143 415/151
3,236,500 A * 2/1966 Kofink ..... F01D 17/143 415/150
3,289,919 A * 12/1966 Wood ..... F01D 17/143 415/150
3,362,624 A * 1/1968 Endress ..... F04D 27/0215 415/1
3,365,120 A * 1/1968 Jassniker ..... F01D 17/143 415/126
3,426,964 A * 2/1969 Silvern ..... F01D 17/143 415/146
3,478,955 A * 11/1969 Kunderman ..... F01D 17/143 415/158
3,619,078 A * 11/1971 Mount ..... F04D 29/464 415/110
3,667,860 A * 6/1972 Byrns ..... F04D 27/0253 415/149.1
3,784,318 A * 1/1974 Davis ..... F04D 15/0038 415/158
4,219,305 A * 8/1980 Mount ..... F04D 29/464 415/13
4,257,733 A * 3/1981 Bandukwalla ..... F04D 29/464 415/13
4,378,194 A * 3/1983 Bandukwalla ..... F01D 17/143 415/146
4,416,583 A * 11/1983 Byrns ..... F04D 29/464 415/148
4,460,310 A * 7/1984 Plunkett ..... F01D 17/143 415/158
4,611,969 A * 9/1986 Zinsmeyer ..... F01D 17/143 415/1
4,643,639 A * 2/1987 Caine ..... F04D 29/468 277/412
4,802,817 A * 2/1989 Tyler ..... F01D 17/143 415/157
4,844,690 A * 7/1989 DeLaurier ..... F01D 17/143 415/148
4,902,200 A * 2/1990 Bandukwalla ..... F01D 17/143 415/148
4,932,835 A * 6/1990 Sorokes ..... F04D 29/462 415/150
4,969,798 A * 11/1990 Sakai ..... F04D 27/0246 415/150
5,059,091 A * 10/1991 Hatfield ..... F04D 27/0284 415/11
5,116,197 A * 5/1992 Snell ..... F04D 29/464 415/126
5,214,920 A * 6/1993 Leavesley ..... F01D 17/143 415/157
5,683,223 A * 11/1997 Harada ..... F04D 27/02 415/17
6,810,666 B2 * 11/2004 Lutz ..... F01D 17/167 415/158
7,326,027 B1 * 2/2008 Skoch ..... F04D 27/0207 415/150
8,689,552 B2 * 4/2014 Iwata ..... F04D 29/462 415/26
8,863,513 B2 * 10/2014 Tabata ..... F04D 27/002 415/148

FOREIGN PATENT DOCUMENTS

DE 102008059462 A1 * 6/2009 ..... F04D 15/0027
DE 102010010223 A1 * 9/2010 ..... F04D 15/0038
EP 0811770 12/1997
EP 0811770 A1 * 12/1997 ..... F04D 27/0253
JP 6-63897 9/1994
JP 2003-293996 A 10/2003
JP 2004-197612 7/2004
KR 1988-0001268 7/1988

* cited by examiner

CENTRIFUGAL COMPRESSOR

CROSS REFERENCE TO RELATED APPLICATIONS

This application claims priority to Japanese Application No. 2014-063570 filed Mar. 26, 2014.

BACKGROUND

The present invention relates to a centrifugal compressor.

In a centrifugal compressor, centrifugal action produced by rotation of the impeller feeds fluid at a high speed into a diffuser passage. The fluid fed to the diffuser passage is decelerated in the diffuser passage to be increased in pressure. The fluid at the increased pressure is thereafter fed into a volute like a scroll provided on the outer circumference of the diffuser passage.

The passage cross-sectional area of the diffuser passage is set to allow fluid to be fed into the diffuser passage at a desired maximum flow rate. Thus, if the fluid is fed into the diffuser passage at a small flow rate and the volute (on the downstream side of the diffuser passage) is in high pressure, the fluid flows backward to cause surging. The occurrence of surging hampers stable operation of the centrifugal compressor.

In this regard, a compressor disclosed in Japanese Laid-Open Utility Model Publication No. 6-63897 includes a throttle portion 102 for adjustment, specifically for control of the passage cross-sectional area of a diffuser passage 101 as shown in FIG. 10. The throttle portion 102 includes a disk-shaped diffuser plate 103 forming one side area of the diffuser passage 101. The diffuser plate 103 is provided in a recess 105 formed in a housing 104 having the diffuser passage 101 to be capable of reciprocating.

The diffuser plate 103 is coupled to one end of each of multiple rods 106 spaced at equal intervals in the circumferential direction. The opposite end of each rod 106 is coupled to a piston 108 arranged in a cylinder 107 of the housing 104 in a manner that allows the piston 108 to reciprocate. The inside of the cylinder 107 is partitioned by the piston 108 into a head chamber 109 and a rod chamber 110. The head chamber 109 is connected via a communication passage 111 to a discharge portion 112. The rod chamber 110 is connected via a communication passage 113 to a suction portion 114. The rod chamber 110 houses a spring 115 that biases the diffuser plate 103 in a direction that increases the passage cross-sectional area of the diffuser passage 101.

If fluid is fed into the diffuser passage 101 at a small flow rate and the discharge portion 112 is in high pressure, large differential pressure is generated between the suction portion 114 and the discharge portion 112. This makes the pressure in the head chamber 109 overcome the biasing force of the spring 115 to move the piston 108 in a direction that increases the volume of the head chamber 109. Thus, the diffuser plate 103 moves in a direction that reduces the passage cross-sectional area of the diffuser passage 101. This reduces the passage cross-sectional area of the diffuser passage 101 to cause the fluid to flow through the diffuser passage 101 smoothly.

In contrast, the lower the pressure at the discharge portion 112, the greater the flow rate of the fluid delivered into the diffuser passage 101 becomes. In this case, the differential pressure between the suction portion 114 and the discharge portion 112 is small. Thus, the biasing force of the spring 115 moves the piston 108 in a direction that reduces the volume of the head chamber 109. Meanwhile, the diffuser plate 103 moves in the direction that increases the passage cross-sectional area of the diffuser passage 101. This increases the passage cross-sectional area of the diffuser passage 101 to cause the fluid to flow through the diffuser passage 101 smoothly.

In the compressor described in the aforementioned publication, the passage cross-sectional area of the diffuser passage 101 is reduced by reducing the passage cross-sectional area between the diffuser plate 103 and the wall surface of the housing 104 facing the diffuser plate 103. Thus, failing to accurately maintain the diffuser plate 103 in its position makes it impossible to keep the diffuser passage 101 in a constant narrowed condition.

SUMMARY

It is an objective of the present invention to provide a centrifugal compressor capable of keeping a diffuser passage in a constant narrowed condition.

To achieve the foregoing objective and in accordance with one aspect of the present invention, a centrifugal compressor is provided that includes a housing having a shroud-side wall surface and a hub-side wall surface, which face each other, an impeller rotationally supported in the housing, an annular diffuser passage, an annular movable member, and an actuation mechanism. The diffuser passage is defined in the housing by the shroud-side wall surface and the hub-side wall surface. The diffuser passage has a passage cross-sectional area. Fluid is delivered to the diffuser passage by centrifugal action produced by rotation of the impeller. The movable member is configured to be projected from one of the shroud-side wall surface and the hub-side wall surface into the diffuser passage and to be retracted from the diffuser passage. The movable member has a through hole with a passage cross-sectional area smaller than the passage cross-sectional area of the diffuser passage. The actuation mechanism projects and retracts the movable member. The other of the shroud-side wall surface and the hub-side wall surface has an abutting portion against which the movable member projected by the actuation mechanism abuts. When the movable member abuts against the abutting portion, an upstream side and a downstream side of the movable member in the diffuser passage communicate with each other via the through hole.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF ILLUSTRATIVE EMBODIMENTS

A centrifugal compressor according to one embodiment will now be described with reference to FIGS. 1 to 5.

Figure 1:
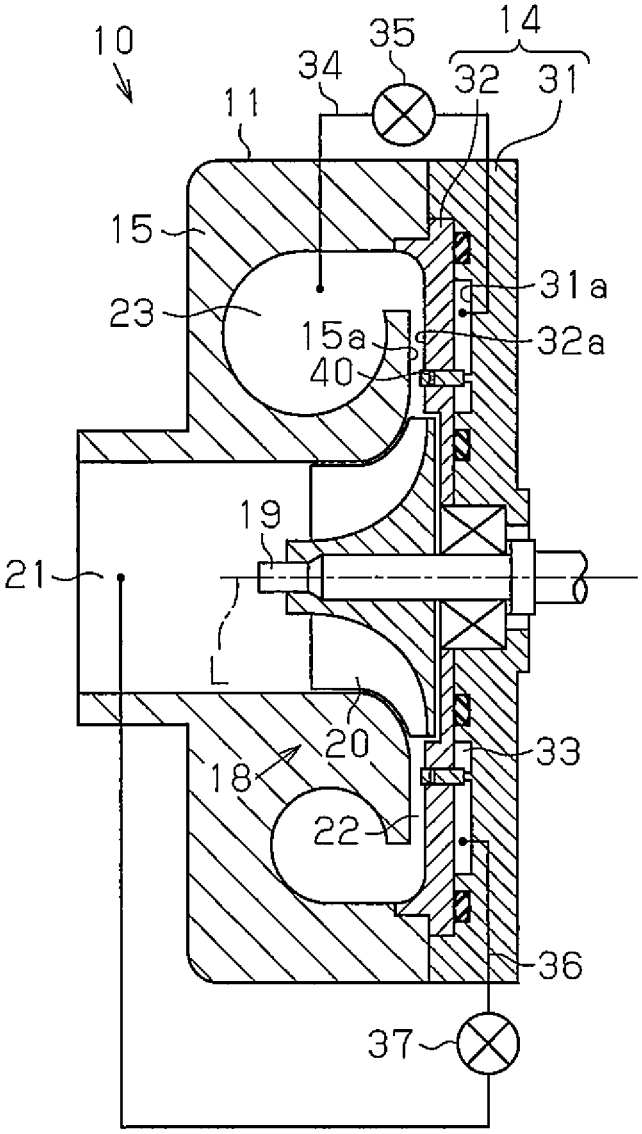
FIG. 1 is a vertical cross-sectional view showing a centrifugal compressor according to one embodiment.

As shown in FIG. 1, a centrifugal compressor 10 includes a housing 11. The housing 11 is made of metal (in the present embodiment, aluminum). The housing 11 has a rear housing member 14 and a front housing member 15 joined to the rear housing member 14. The front housing member 15 houses a compression mechanism 18 for compression of fluid. An output shaft 19 extends through the rear housing member 14 to protrude into the front housing member 15 at a central portion of the front housing member 15. The output shaft 19 is rotationally supported by the rear housing member 14. The output shaft 19 is rotated by actuation of a driving mechanism (not shown).

The compression mechanism 18 has an impeller 20 arranged at a central portion of the inside of the front housing member 15. The impeller 20 is attached to an end of the output shaft 19 in the front housing member 15. A suction port 21, through which fluid is drawn in to be introduced toward the impeller 20, is formed at the central portion of the front housing member 15. The suction port 21 extends in the direction in which a rotation axis L of the output shaft 19 extends (axial direction). The front housing member 15 is further provided with an annular diffuser passage 22 extending outward in the radial direction of the output shaft 19 from the impeller 20. The passage cross-sectional area of the diffuser passage 22 is set to allow fluid to be fed into the diffuser passage 22 at a desired maximum flow rate. The front housing member 15 is also provided with a volute 23 like a scroll communicating with the diffuser passage 22 on an outer side of the radial direction of the diffuser passage 22.

Rotation of the output shaft 19 rotates the impeller 20 to draw in fluid and introduce the fluid toward the impeller 20 through the suction port 21. The fluid introduced toward the impeller 20 through the suction port 21 is delivered to the diffuser passage 22 at a high speed by centrifugal action produced by the rotation of the impeller 20. The fluid fed to the diffuser passage 22 is decelerated in the diffuser passage 22 to be increased in pressure, specifically compressed. The fluid in the increased pressure is fed into the volute 23 and then fed from the volute 23 to the outside of the centrifugal compressor 10.

Figure 2:
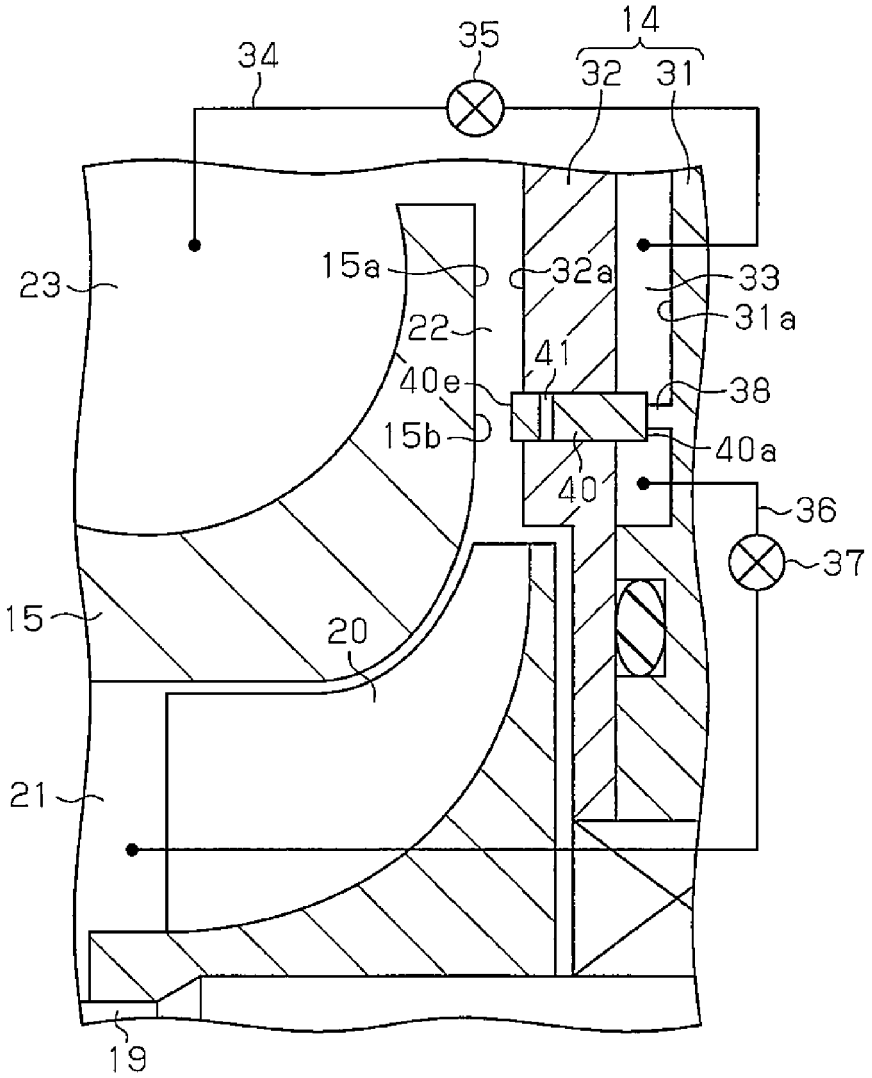
FIG. 2 is a partial enlarged cross-sectional view showing a movable member in a retracted state.

As shown in FIG. 2, the rear housing member 14 is formed of a first housing section 31 and a second housing section 32 coupled to the first housing section 31. The second housing section 32 has a hub-side wall surface 32*a* forming the diffuser passage 22. The hub-side wall surface 32*a* and a shroud-side wall surface 15*a* of the front housing member 15, which faces the hub-side wall surface 32*a*, define the diffuser passage 22. An end surface of the first housing section 31 facing the second housing section 32 is provided with an annular recess 31*a*. The recess 31*a* and the second housing section 32 define a back pressure chamber 33.

The back pressure chamber 33 and the volute 23 are connected to each other via a communication passage 34. An electromagnetic control valve 35 is provided in the communication passage 34. The control valve 35 is an on-off valve to open and close the communication passage 34. Opening the control valve 35 makes the back pressure chamber 33 and the volute 23 communicate with each other via the communication passage 34 to introduce fluid from the volute 23 into the back pressure chamber 33 via the communication passage 34. Closing the control valve 35 cuts off the communication between the back pressure chamber 33 and the volute 23 via the communication passage 34 to stop introduction of fluid from the volute 23 into the back pressure chamber 33 via the communication passage 34.

The back pressure chamber 33 communicates with the suction port 21 via an exhaust passage 36. An electromagnetic control valve 37 is provided in the exhaust passage 36. The control valve 37 is an on-off valve to open and close the exhaust passage 36. Opening the control valve 37 makes the back pressure chamber 33 and the suction port 21 communicate with each other via the exhaust passage 36 to discharge fluid in the back pressure chamber 33 to the suction port 21 via the exhaust passage 36. Closing the control valve 37 cuts off the communication between the back pressure chamber 33 and the suction port 21 via the exhaust passage 36 to stop discharge of fluid from the back pressure chamber 33 to the suction port 21 via the exhaust passage 36.

An annular movable member 40 is provided to the second housing section 32 in a manner that allows the movable member 40 to be projected into and retracted from the diffuser passage 22 through the hub-side wall surface 32*a*. The movable member 40 is arranged at a position near the entrance of the direction in which fluid circulates through the diffuser passage 22 (near the impeller 20). Specifically, the movable member 40 is arranged between an intermediate position of the diffuser passage 22 and an outer circumferential end of the impeller 20. The shroud-side wall surface 15*a* has an abutting portion 15*b* against which the movable member 40 in a protruded state abuts.

An annular contact portion 38 to contact the movable member 40 is provided to protrude from the bottom surface of the recess 31*a*. The contact portion 38 is set to be thinner than the movable member 40. When the movable member 40 is retracted in the back pressure chamber 33 to contact the contact portion 38, an end surface of the movable member 40 facing the contact portion 38 partially protrudes from the contact portion 38. The fluid introduced into the back pressure chamber 33 acts on the protruding end surface of the movable member 40. In this way, the end surface of the movable member 40 facing the contact portion 38 forms a fluid receiving surface 40*a*, which receives the fluid introduced into the back pressure chamber 33.

When the movable member 40 is retracted in the back pressure chamber 33 and the fluid receiving surface 40*a* contacts the contact portion 38, an end surface 40*e* of the movable member 40 on the opposite side from the contact portion 38 is protruded slightly from the hub-side wall surface 32*a*.

Figure 3:
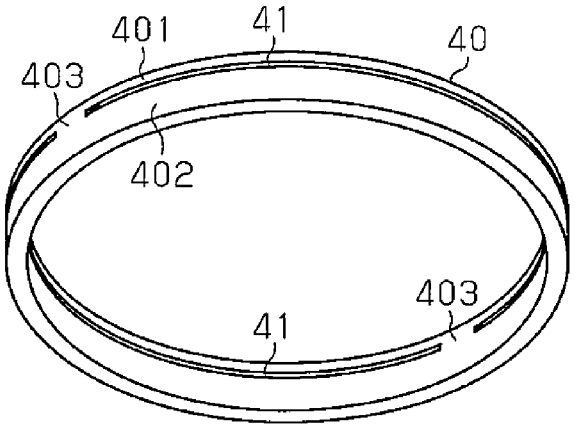
FIG. 3 is a perspective view of the movable member.

As shown in FIG. 3, the movable member 40 is provided with a pair of slits 41 extending through the movable member 40 and extending in the circumferential direction of the movable member 40. The movable member 40 is partitioned by the slits 41 into a first end 401 located on one side of a direction of the projection and retraction of the movable member 40 and a second end 402 on the opposite side in this direction. The slits 41 are arranged in the circumferential direction of the movable member 40 while linking portions 403, which link the first and second ends 401 and 402, are located between the slits 41. Specifically, the multiple slits 41 are formed in the movable member 40.

Figure 4:
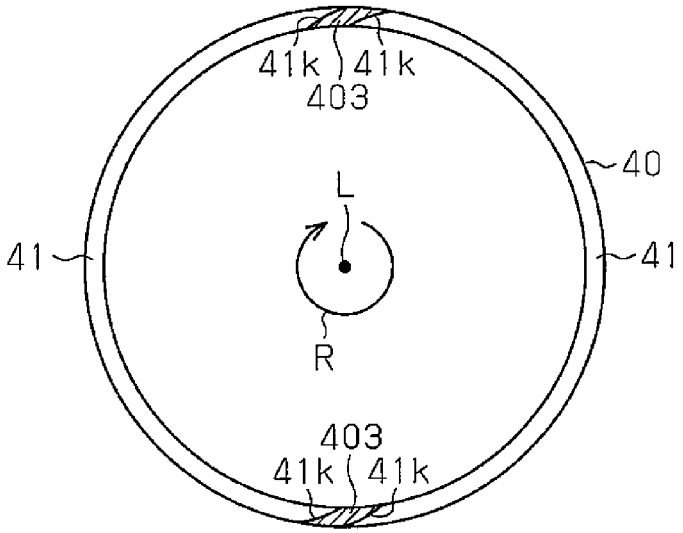
FIG. 4 is a vertical cross-sectional view of the movable member.

As shown in FIG. 4, the linking portions 403 are arranged at opposite positions in the circumferential direction of the movable member 40. Surfaces of each linking portion 403 arranged in the circumferential direction of the movable member 40 are tilted in a direction of the rotation of the impeller 20 (direction of arrow R of FIG. 4). Thus, each slit 41 has two tilted surfaces 41*k* tilted in the direction of the rotation of the impeller 20 relative to the radial direction of the movable member 40.

Figure 5:
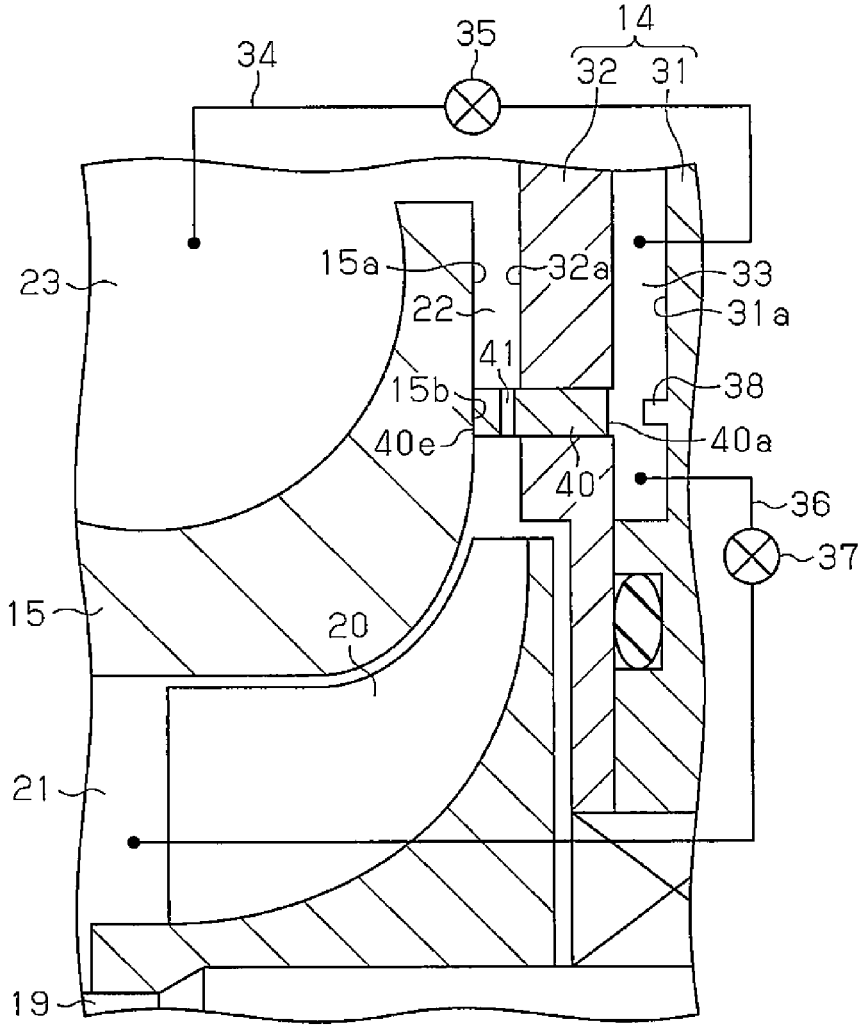
FIG. 5 is a partially enlarged cross-sectional view showing the movable member in a projected state.

As shown in FIG. 5, when the movable member 40 is projected to abut against the abutting portion 15*b*, the upstream side and the downstream side of the movable member 40 in the diffuser passage 22 communicate with each other via each slit 41. In this way, each slit 41 forms a through hole through which the upstream and downstream sides of the movable member 40 in the diffuser passage 22 communicate with each other when the movable member 40 in the protruded state abuts against the abutting portion 15*b*. The passage cross-sectional area of each slit 41 is set to be smaller than that of the diffuser passage 22.

Each slit 41 is formed in the movable member 40 to be placed at a closer to the hub-side wall surface 32*a* than to the shroud-side wall surface 15*a* when the movable member 40 is projected to abut against the abutting portion 15*b*. Specifically, each slit 41 is formed to be placed at a position between the shroud-side wall surface 15*a* and the hub-side wall surface 32*a* and closer to the hub-side wall surface 32*a* when the movable member 40 abuts against the abutting portion 15*b*.

Operation of the present embodiment will now be described.

In the present embodiment, if fluid is fed into the diffuser passage 22 at a small flow rate and the volute 23 is in a desired high pressure, the control valve 35 is opened and the control valve 37 is closed. Then, the fluid in the volute 23 is introduced into the back pressure chamber 33 via the communication passage 34. Specifically, fluid on the downstream side of the movable member 40 in the circulation direction is introduced as back pressure into the back pressure chamber 33.

The fluid introduced into the back pressure chamber 33 acts on the fluid receiving surface 40*a* of the movable member 40. As a result of large differential pressure between the back pressure chamber 33 and the diffuser passage 22, the pressure (back pressure) of the fluid in the back pressure chamber 33 projects the movable member 40 toward the abutting portion 15*b*. When the movable member 40 abuts against the abutting portion 15*b*, the upstream and downstream sides of the movable member 40 in the diffuser passage 22 communicate with each other via each slit 41. Thus, the diffuser passage 22 is narrowed to each slit 41, so that the flow of fluid fed into the diffuser passage 22 is adjusted when passing through each slit 41. As a result, even if the fluid is fed into the diffuser passage 22 at a small flow rate and the volute 23 is in the desired high pressure, the fluid is caused to flow smoothly through the diffuser passage 22. The passage cross-sectional area of each slit 41 is fixed. Thus, when the upstream and downstream sides of the movable member 40 in the diffuser passage 22 communicate with each other via each slit 41, the diffuser passage 22 is kept in a constantly narrowed condition. Specifically, the passage cross-sectional area of the diffuser passage 22 is kept constant.

If fluid is fed into the diffuser passage 22 at a large flow rate, the control valve 35 is closed and the control valve 37 is opened. Then, the fluid in the back pressure chamber 33 is discharged to the suction port 21 via the exhaust passage 36. This makes the pressure in the back pressure chamber 33 approach the atmospheric pressure to reduce the differential pressure between the back pressure chamber 33 and the diffuser passage 22. Thus, the movable member 40 is retracted in the back pressure chamber 33 by the pressure of the fluid passing through each slit 41. As a result, even if the fluid flows through the diffuser passage 22 at the large flow rate, the fluid is caused to flow smoothly through the diffuser passage 22. In the present embodiment, each of the control valves 35 and 37 forms an actuation mechanism to project and retract the movable member 40 by controlling pressure in the back pressure chamber 33.

The aforementioned embodiment achieves the following advantages.

(1) When the movable member 40 is projected to abut against the abutting portion 15*b*, the upstream and downstream sides of the movable member 40 in the diffuser passage 22 communicate with each other via each slit 41. This allows narrowing of the diffuser passage 22 with each slit 41. The passage cross-sectional area of each slit 41 is fixed. Thus, when the upstream and downstream sides of the movable member 40 in the diffuser passage 22 communicate with each other via each slit 41, the diffuser passage 22 can be kept in a constantly narrowed condition. Specifically, the passage cross-sectional area of the diffuser passage 22 is kept constant.

(2) The projection and retraction of the movable member 40 can be controlled only by controlling the pressure in the back pressure chamber 33 with the control valves 35 and 37. Further, the movable member 40 is projected and retracted without the need of preparing an additional member for projecting and retracting the movable member 40.

(3) Fluid on the downstream side of the movable member 40 in the circulation direction of the fluid is introduced into the back pressure chamber 33. This simplifies the structure compared with a structure in which fluid that is different from the fluid flowing through the diffuser passage 22 is introduced into the back pressure chamber 33.

(4) Each slit 41 is formed in the movable member 40 to be placed at a position closer to the hub-side wall surface 32*a* than to the shroud-side wall surface 15*a* when the movable member 40 is projected to abut against the abutting portion 15*b*. Specifically, each slit 41 is formed in the movable member 40 to be placed at a position closer to the hub-side wall surface 32*a* than an intermediate position between the shroud-side wall surface 15*a* and the hub-side wall surface 32*a*. A portion of the diffuser passage 22 closer to the hub-side wall surface 32*a* than to the shroud-side wall surface 15*a* easily offers a circulation passage for the fluid to be delivered to the diffuser passage 22 by centrifugal action produced by the rotation of the impeller 20. Thus, by placing each slit 41 at a position close to the hub-side wall surface 32*a*, the fluid fed into the diffuser passage 22 is allowed to flow easily into each slit 41. As a result, the fluid passes through each slit 41 easily. This restrains surging and improves the efficiency of the centrifugal compressor 10.

(5) Each slit 41 has two tilted surfaces 41*k* tilted in the direction of the rotation of the impeller 20 relative to the radial direction of the movable member 40. This allows fluid delivered to the diffuser passage 22 by centrifugal action produced by the rotation of the impeller 20 to pass through each slit 41 smoothly.

(6) Each slit 41 extends in the circumferential direction of the movable member 40. This makes it possible to provide space reliably as a through hole extending continuously in the circumferential direction of the movable member 40. As a result, fluid is allowed to flow smoothly through each slit 41.

(7) Even if fluid is fed into the diffuser passage 22 at a small flow rate and the volute 23 is in desired high pressure, the fluid is allowed to flow through the diffuser passage 22 smoothly. This expands the operating range of the centrifugal compressor 10.

(8) The annular contact portion 38 to contact the movable member 40 is provided to protrude from the bottom surface of the recess 31*a*. The contact portion 38 is set to be thinner than the movable member 40. This allows fluid introduced into the back pressure chamber 33 to act on the fluid receiving surface 40*a* of the movable member 40 easily, thereby moving the movable member 40 smoothly in the direction in which the movable member 40 is projected.

(9) When the movable member 40 is retracted in the back pressure chamber 33 and the fluid receiving surface 40*a* contacts the contact portion 38, the end surface 40*e* of the movable member 40 on the opposite side from the contact portion 38 is protruded slightly from the hub-side wall surface 32*a*. This prevents the end surface 40*e* of the movable member 40 from getting caught on the second housing section 32 when the movable member 40 in a retracted state in the back pressure chamber 33 is moved in the projecting direction. As a result, the movable member 40 is moved smoothly in the direction in which the movable member 40 is projected.

(10) The projection and retraction of the movable member 40 is controlled by controlling pressure in the back pressure chamber 33 with each of the control valves 35 and 37. Thus, surging of the centrifugal compressor 10 is suppressed in accordance with various operating conditions of the centrifugal compressor 10, so that the centrifugal compressor 10 is operated efficiently.

The aforementioned embodiment may be modified as follows.

Figure 6:
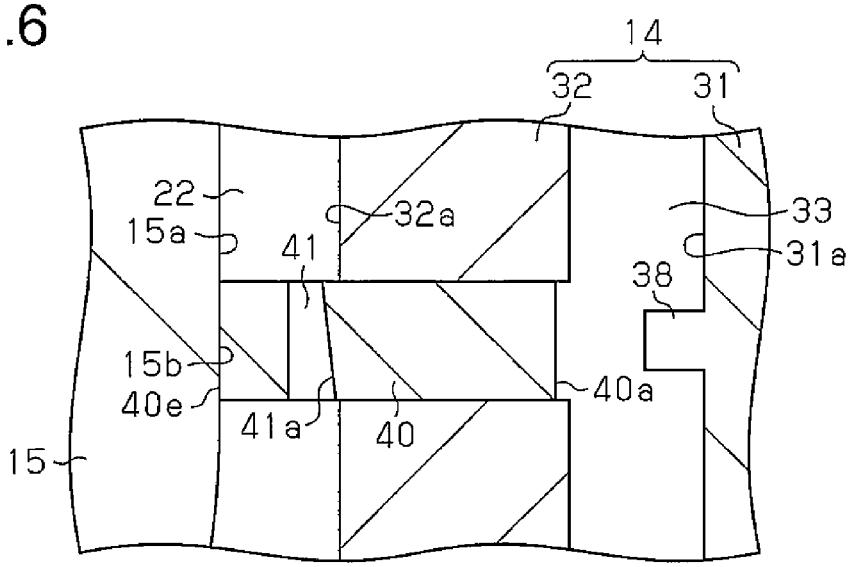
FIG. 6 is a partially enlarged cross-sectional view showing a movable member in a projected state according to another embodiment.

As shown in FIG. 6, the slit 41 may have a pressure receiving surface 41*a* tilted to receive dynamic pressure acting in the direction in which the movable member 40 is retracted in response to circulation of fluid. The pressure receiving surface 41*a* is tilted such that, when the movable member 40 contacts the abutting portion 15*b*, an upstream end of the pressure receiving surface 41*a* is closer to the hub-side wall surface 32*a* than the downstream end of the pressure-receiving surface 41*a*. In other words, the pressure receiving surface 41*a* is inclined with respect to the hub-side wall surface 32*a* such that the upstream end of the slit 41 is wider than the downstream end of the slit 41. This makes the dynamic pressure of the fluid act on the pressure receiving surface 41*a* when fluid passes through each slit 41. Thus, during retraction of the movable member 40, the movable member 40 is allowed to move smoothly in the direction in which the movable member 40 is retracted.

Figure 7:
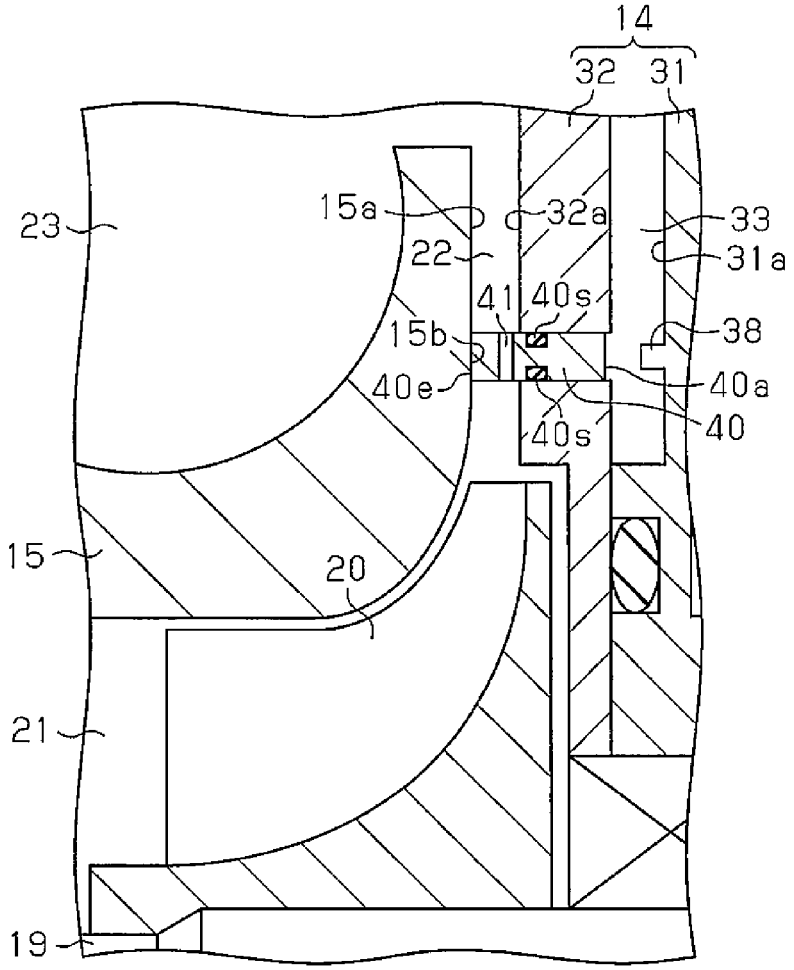
FIG. 7 is a partially enlarged cross-sectional view showing a movable member in a projected state according to a still another embodiment.

As shown in FIG. 7, an annular sealing member 40*s* may be attached to each of the outer circumferential surface and the inner circumferential surface of the movable member 40 for sealing between the movable member 40 and the second housing section 32. In this case, fluid to be introduced into the back pressure chamber 33 may be different from fluid to flow through the diffuser passage 22. Examples of the fluid different from the fluid to flow through the diffuser passage 22 include oil used for purposes such as lubrication of sliding members or cooling of a heat generator of the driving mechanism and coolant used for cooling of the heat generator of the driving mechanism. If such oil or coolant is introduced into the back pressure chamber 33, the heat of the fluid is transmitted through the second housing section 32 to the oil or coolant. This allows cooling of the fluid, thereby enhancing the operation efficiency of the centrifugal compressor 10.

Figure 8:
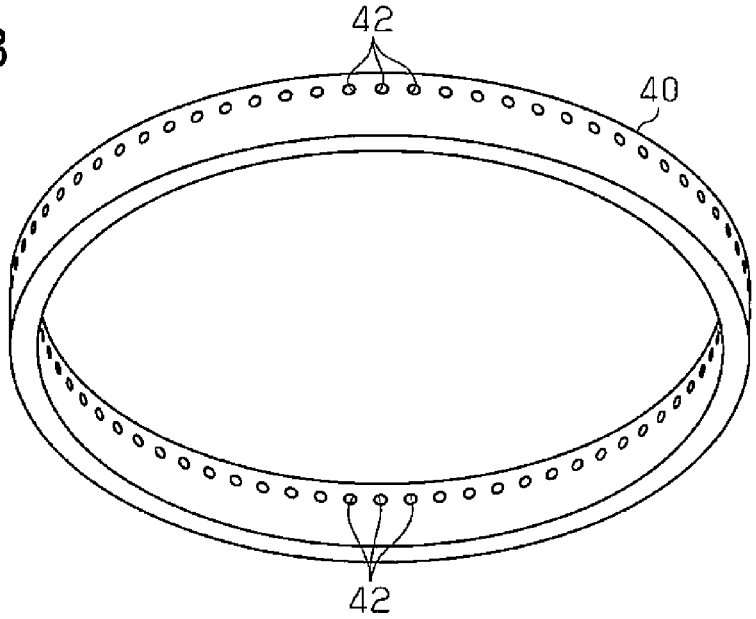
FIG. 8 is a perspective view of a movable member according to a yet another embodiment.

As shown in FIG. 8, multiple through holes 42 that extend through the movable member 40 and are arranged in the circumferential direction of the movable member 40 may be formed as through holes, for example. The holes 42 are shown to be circular in FIG. 8. The shape of the holes 42 is not particularly limited and may be an oval, for example.

In the above illustrated embodiment, the surfaces of the linking portion 403 arranged in the circumferential direction of the movable member 40 may extend in the radial direction of the movable member 40.

In the above illustrated embodiment, three or more linking portions 403 may be formed in the movable member 40. Specifically, three or more slits 41 may be formed in the movable member 40.

In the above illustrated embodiment, each slit 41 may be formed in the movable member 40 to be placed at a position closer to the shroud-side wall surface 15*a* than to the hub-side wall surface 32*a* when the movable member 40 is projected to abut against the abutting portion 15*b*.

In the above illustrated embodiment, the movable member 40 may be arranged at a position near the exit of the direction in which fluid circulates through the diffuser passage 22 (near the volute 23).

The contact portion 38 may be omitted from the above illustrated embodiment. Even in this case, fluid flows in between the bottom surface of the recess 31*a* and the end surface of the movable member 40 facing the bottom surface of the recess 31*a*. This makes the fluid act on the fluid receiving surface 40*a* of the movable member 40 to project the movable member 40 toward the abutting portion 15*b*.

In the above illustrated embodiment, the movable member 40 may be projected and retracted using an electromagnetic actuator, for example. In this case, the actuator forms the actuation mechanism to project and retract the movable member 40.

Figure 9:
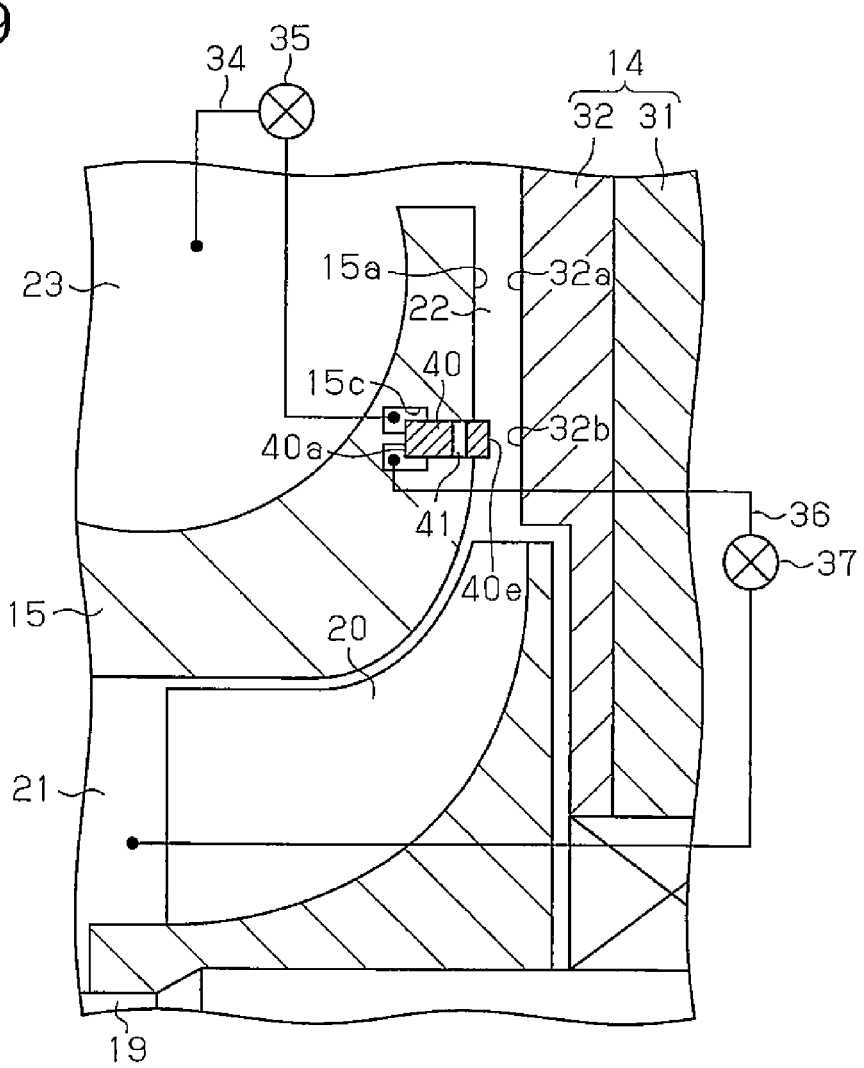
FIG. 9 is a partial enlarged cross-sectional view showing a movable member according to a further embodiment in a retracted state.
Figure 10:
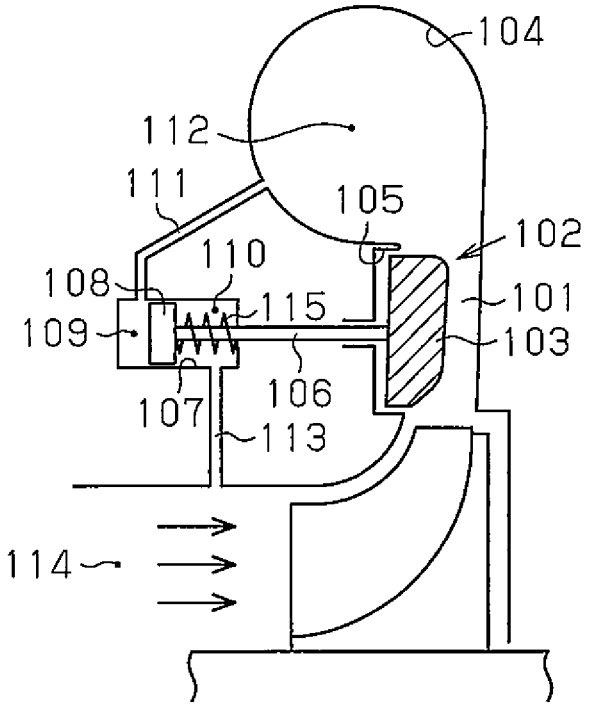
Fig.10(Prior Art)
FIG. 10 is a partial enlarged cross-sectional view of a conventional centrifugal compressor.

In the above illustrated embodiment, the movable member 40 may be provided in a manner that allows the movable member 40 to be projected into and retracted from the diffuser passage 22 through the shroud-side wall surface 15*a* as illustrated in FIG. 9. That is, the movable member 40 may be modified as long as it is allowed to be projected into and retracted from the diffuser passage 22 through either one of the shroud-side wall surface 15*a* and the hub-side wall surface 32*a*. In the case of FIG. 9, the hub-side wall surface 32*a* has an abutting portion 32*b* against which the movable member 40 in a projected state abuts. A back pressure chamber 15*c* is formed in the front housing member 15. When fluid is introduced into the back pressure chamber 33, the movable member 40 is projected into the diffuser passage 22. This causes the end face 40*e* of the movable member 40 to contact the abutting portion 32*b*. As a result, the slit 41 is located in the diffuser passage 22 to narrow the diffuser passage 22. The modification shown in FIG. 9 achieves the same advantages as those of the above described embodiment.

In the above illustrated embodiment, the back pressure chamber 33 may communicate with the outside of the centrifugal compressor 10 via the exhaust passage 36.

In the above illustrated embodiment, when the movable member 40 is retracted in the back pressure chamber 33 and the fluid receiving surface 40*a* contacts the contact portion 38, the end surface 40*e* of the movable member 40 on the opposite side from the contact portion 38 does not need to be protruded from the hub-side wall surface 32*a*.

In the above illustrated embodiment, the centrifugal compressor 10 may be applied to a turbocharger, for example.

Therefore, the present examples and embodiments are to be considered as illustrative and not restrictive and the invention is not to be limited to the details given herein, but may be modified within the scope and equivalence of the appended claims.

What is claimed:

1. A centrifugal compressor comprising:

a housing having a shroud-side wall surface and a hub-side wall surface, which face each other;

an impeller rotationally supported in the housing;

an annular diffuser passage defined in the housing by the shroud-side wall surface and the hub-side wall surface, wherein the diffuser passage has a passage cross-sectional area, and fluid is delivered to the diffuser passage by centrifugal action produced by rotation of the impeller;

an annular movable member that is configured to be projected from one of the shroud-side wall surface and the hub-side wall surface into the diffuser passage and to be retracted from the diffuser passage, wherein the other of the shroud-side wall surface and the hub-side wall surface has an abutting portion against which the movable member abuts and the movable member has a first end surface that faces the shroud-side wall surface and a second end surface that is opposite to the first end surface and is continuous in a circumferential direction of the movable member, and wherein the movable member has at least two slits extending in the circumferential direction of the movable member, each slit having a length in the circumferential direction of the movable member that is greater than a length of each slit in an axial direction of the movable member, said slits having a passage cross-sectional area smaller than the passage cross-sectional area of the diffuser passage; and an actuator that projects and retracts the movable member, wherein when the movable member abuts against the abutting portion, an upstream side and a downstream side of the movable member in the diffuser passage communicate with each other via the slits.

2. The centrifugal compressor according to claim 1, wherein the housing includes a back pressure chamber into which fluid is introduced, the fluid allowing the movable member to be projected into and retracted from the diffuser passage, and the actuator includes a control valve that controls pressure in the back pressure chamber.

3. The centrifugal compressor according to claim 2, wherein fluid on a downstream side of the movable member in a circulation direction of the fluid is introduced into the back pressure chamber.

4. The centrifugal compressor according to claim 1, wherein each slit has a pressure receiving surface that is tilted to receive a dynamic pressure acting in a direction in which the movable member is retracted by circulation of the fluid.

5. The centrifugal compressor according to claim 1, wherein each slit is located at a position closer to the hub-side wall surface than to the shroud-side wall surface when the movable member abuts against the abutting portion.

6. The centrifugal compressor according to claim 1, wherein each slit has a tilted surface tilted in a direction of rotation of the impeller relative to a radial direction of the movable member.

7. The centrifugal compressor according to claim 2, wherein the actuator further comprises a second control valve that discharges fluid in the back pressure chamber to an exhaust passage when opened.

8. The centrifugal compressor according to claim 1, wherein the actuator comprises an electromagnetic actuator.

9. The centrifugal compressor according to claim 2, wherein the movable member comprises an annular sealing member that seals between the movable member and the housing so as to separate the annular diffuser passage from the back pressure chamber.

* * * * *